US005919056A

United States Patent [19]

Suzuki et al.

[11] Patent Number: 5,919,056

[45] Date of Patent: Jul. 6, 1999

[54] CONNECTOR DISENGAGING MECHANISM

[75] Inventors: Etsuro Suzuki; Naomi Omura, both of Shizuoka, Japan

[73] Assignee: Yazaki Corporation, Tokyo, Japan

[21] Appl. No.: 08/777,379

[22] Filed: Dec. 27, 1996

[30] Foreign Application Priority Data

Dec. 28, 1995 [JP] Japan ..... 7-343959

[51] Int. Cl.[6] ..... H01R 13/627

[52] U.S. Cl. ..... 439/352

[58] Field of Search ..... 439/352, 353, 439/354, 355, 357, 488, 489

[56] References Cited

U.S. PATENT DOCUMENTS 5,041,017 8/1991 Nakazato et al. ..... 439/352
5,217,385 6/1993 Inuoe et al. ..... 439/353

FOREIGN PATENT DOCUMENTS

GM 18 46
661 11/1961 Germany .

AS 29 07 967 7/1980 Germany .

*Primary Examiner*—Gary Paumen
*Attorney, Agent, or Firm*—Sughrue, Mion, Zinn, Macpeak & Seas, PLLC

[57] ABSTRACT

A housing of a female connector has an accommodating space, an opening, and lock stoppers. The accommodating space retains a mating connector, and accommodates a slide lock member and a resilient member. The accommodating space is arranged close to a terminal accommodating chamber so as to be slidable in an engaging direction, the terminal accommodating chamber allowing a connecting terminal to be inserted thereinto. The slide lock member is biased during disengaging operation. The opening is arranged on part of the accommodating space and causes part of the slide lock member to be exposed. The lock stopper is arranged on a side surfaces of the accommodating space and suppresses movement of the mating connector. The slide lock member has a flexible disengaging arm that has a separating projection. The separating projection is pressed during the disengaging operation.

3 Claims, 7 Drawing Sheets

CONNECTOR DISENGAGING MECHANISM

BACKGROUND OF THE INVENTION

1. Field of the Invention

This invention relates to a connector disengaging mechanism in which when male and female connectors are left half-engaged, the connectors can be disengaged from each other by a rebounding force of a resilient member, and further, when the connectors are completely engaged, the connectors can be disengaged from each other with ease.

2. Background

Various types of half-engagement preventing connector devices have heretofore been known. For example, such a half-engagement preventing connector device as disclosed in Unexamined Japanese Utility Model Publication No. Hei. 5-81967 and the like is known.

As shown in FIGS. 6 and 7, a pin-side connector 50 has therein a plurality of pin contacts 52 in a row and has attaching flanges 50*a* on both sides thereof. A socket-side connector 51 has therein a plurality of socket contacts 53 in a row. An electric wire 53*a* is connected to a socket contact 53.

The pin-side connector 50 has a boxlike housing 54 with an opening in the front portion thereof. Guide plates 55 are arranged within the housing 54 so that the guide plates 55 can partition the upper and lower portions of the housing in the middle. The guide plates 55 guide the socket-side connector 51 so as to be engaged with the pin-side connector 50. As shown in FIG. 7, the pin contacts 52 project from the rear to the front within the housing 54. A notched portion is formed in a middle portion of a top plate 54*b*. An engaging piece 56 is integrally formed with the top plate 54*b* so as to extend frontwardly from the notched portion. The front end of the engaging piece 56 is receded from the front end edge of the top plate 54*b* and is so flexible as to be curved slightly outward. An engaging projection 56*a* is formed on an inner end portion of the engaging piece 56.

The socket-side connector 51 has a boxlike housing 57 and is as large in size as to be fittable into the opening of the housing 54 of the pin-side connector 50. Pin holes 58 into which the pin contacts 52 are inserted and elongated holes 59 into which the guide plates 55 are inserted are arranged in the front of the housing 57.

A movable cover 60 covers the outer side of the housing 57 so as to be movable from the front to the rear while leaving the front and rear portions of the housing 57 exposed. An opening 61 into which the socket-side connector 50 is inserted is arranged in the front of the movable cover 60. This opening 61 is designed so large in size as to allow both side plates 54*a*, the top plate 54*b*, and a bottom plate 54*c* of the housing 54 of the pin-side connector 50 to be inserted thereinto, and further so large in size as to prevent the engaging projection 56*a* of the engaging piece 56 and the front end of the engaging piece 56 from being inserted thereinto because the engaging projection 56*a* of the engaging piece 56 collides against the outer side of the opening 61 and the front end of the engaging piece 56 collides against the edge of the opening 61.

Spring accommodating portions (not shown in the drawing) are provided on both sides of the housing 57 and the movable cover 60 so as to be diametrically opposed. Inside the spring accommodating portions are springs 64, which are accommodated as shown by the dotted lines in FIG. 6. The movable cover 60 is biased frontward, i.e., leftward as viewed in FIG. 6, by the springs 64 at all times, and is retained by elongated holes 65 arranged in the upper portion thereof and projections 66 arranged on the upper portion of the housing 57. An engaging groove 67 engageable with the engaging projection 56*a* of the engaging piece 56 is arranged on the side portion of the housing 57. The engaging groove 67 engages with the engaging projection 56*a* when the connectors are completely connected to each other. This engaging groove 67 is arranged at such a position as to be normally concealed by the movable cover 60 and so as to appear when the movable cover 60 is moved.

When the connectors 50, 51 are engaged with each other, the pin contacts 52 and the socket contacts 53 come in contact with one another as shown in FIG. 7, and the engaging projection 56*a* engages with the engaging groove 67. At the time the connectors are engaged with each other, the springs 64 are compressed, and further the engaging piece 56 is covered with the movable cover 60, so that the engaging projection 56*a* can in no way come off from the engaging groove 67. As a result, the connected condition can be reliably maintained.

On the other hand, if the connectors are not completely connected, i.e., half-connected, then the front end of the engaging piece 56 collides against the edge of the opening of the movable cover 60 and the springs 64 get compressed. As a result, the movable cover 60 biases the engaging piece 56 by the pressure of the springs 64, which in turn separates both connectors 50, 51 from each other, not allowing the connectors 50, 51 to be connected at all.

The aforementioned connector device can prevent half-engagement. However, if one tries to engage the connectors by holding both side surfaces of the movable cover 60, movement of the movable cover 60 is blocked, which in turn prevents the connectors from being engaged. Further, since the engaging piece 56 is not covered with the housing 57 when the connectors are completely engaged, the engaging piece 56 is easy to move when an external force is applied to the movable cover 60. Thus, there exists the problem that the engaging piece 56 unexpectedly comes out even in the engaged condition.

SUMMARY OF THE INVENTION

The invention has been made in view of the aforementioned problem. The object of the invention is to provide a connector disengaging mechanism for preventing the connectors from coming off from each other easily by an external force, and further, allowing a disengaging operation to be performed easily at the time of releasing the engaged condition of the connectors.

The above object can be achieved by a connector disengaging mechanism including: a female connector having a housing, a terminal accommodating chamber, for accommodating a terminal, formed in the housing, a slide lock member slidably accommodated within the housing, a resilient member attached between the slide lock member and an inner wall of the housing, and a support mechanism formed in the housing to slidably support the slide lock member; and a male connector having a housing having a lock member for engaging the slide lock member when the female and male connectors are connected to each other, and a terminal accommodating chamber, for accommodating a terminal, formed in the housing, in which the female and male connectors are disengaged from each other by pressing a predetermined position of the slide lock member.

In the connector disengaging mechanism, there is an accommodating space, for accommodating the slide lock member and the resilient member, arranged in the housing of the female connector close to the terminal accommodating chamber.

In the connector disengaging mechanism, there is an opening arranged in a part of the accommodating space, the opening allowing a part of the slide lock member to be exposed to the outside of the housing of the female connector.

Further, the slide lock member includes a flexible disengaging arm having a separating projection pressed at the time of disengaging the connectors from each other.

Further, the lock member of the male connector includes a flexible lock arm, a housing lock retained by the slide lock member on an upper portion of the flexible lock arm, and incomplete engagement preventing locks projecting respectively from side surfaces of the lock arm.

Further, the support mechanism has a lock stopper for preventing an incomplete engagement of the connectors, the lock stopper suppresses flexion of the lock arm caused during connector engaging operation in cooperation with an operation of the incomplete engagement preventing lock.

Further, the support mechanism includes first guide grooves and second guide grooves.

Further, the slide lock member has slide stoppers inserted into the first guide grooves and support projections inserted into the second guide grooves.

According to the thus constructed connector disengaging mechanism, the connectors are disengaged from each other by pressing the separating projection of the slide lock member from above so that the disengaging arm downwardly flexes. The flexion of the disengaging arm brings the disengaging arm into contact with the housing lock of the lock arm positioned below the disengaging arm, and if the separating projection is pressed further down, the lock arm in the housing lock portion flexes downward, thereby releasing the engaged condition of the housing lock.

If the separating projection is pressed in the disengaging direction under this condition, the connectors are disengaged from each other by a single hand easily.

Further, for engaging the connectors with each other again, the following operation is performed. When the housing lock pushes the slide lock member in the engaging direction while resisting the biasing force of the resilient member, the rebounding force of the resilient member becomes greater than the connector inserting force when the incomplete engagement preventing lock rides over the lock stopper. As a result, the lock arm flexes, and when the slide lock member returns to the original position by taking advantage of the rebounding force of the resilient member, the connectors are engaged completely.

Therefore, when the hand is released before the incomplete engagement preventing lock of the lock arm rides over the lock stopper, the female and male connectors are separated from each other by the rebounding force of the resilient member, which in turn prevents half-engagement. As a result, when the operation of engaging the connectors is to be performed, the operator can perform the engaging operation by holding the side walls of the female housing since the slide lock member is covered with the female housing.

Further, the incomplete engagement preventing lock and the lock stopper can reliably prevent the lock arm from flexing in the course of engaging the connectors. Therefore, the lock arm can flex only when the connectors have been completely engaged, which in turn prevents incomplete engagement reliably.

Still further, the slide lock member retains the housing lock when the connectors are completely engaged. As a result, the slide lock member is covered with the female housing and therefore is less affected by an external force.

DETAILED DESCRIPTION OF THE PREFERRED EMBODIMENTS

A connector disengaging mechanism, which is one mode of embodiment of the invention, will now be described in detail with reference to FIGS. 1 to 5.

Figure 1:
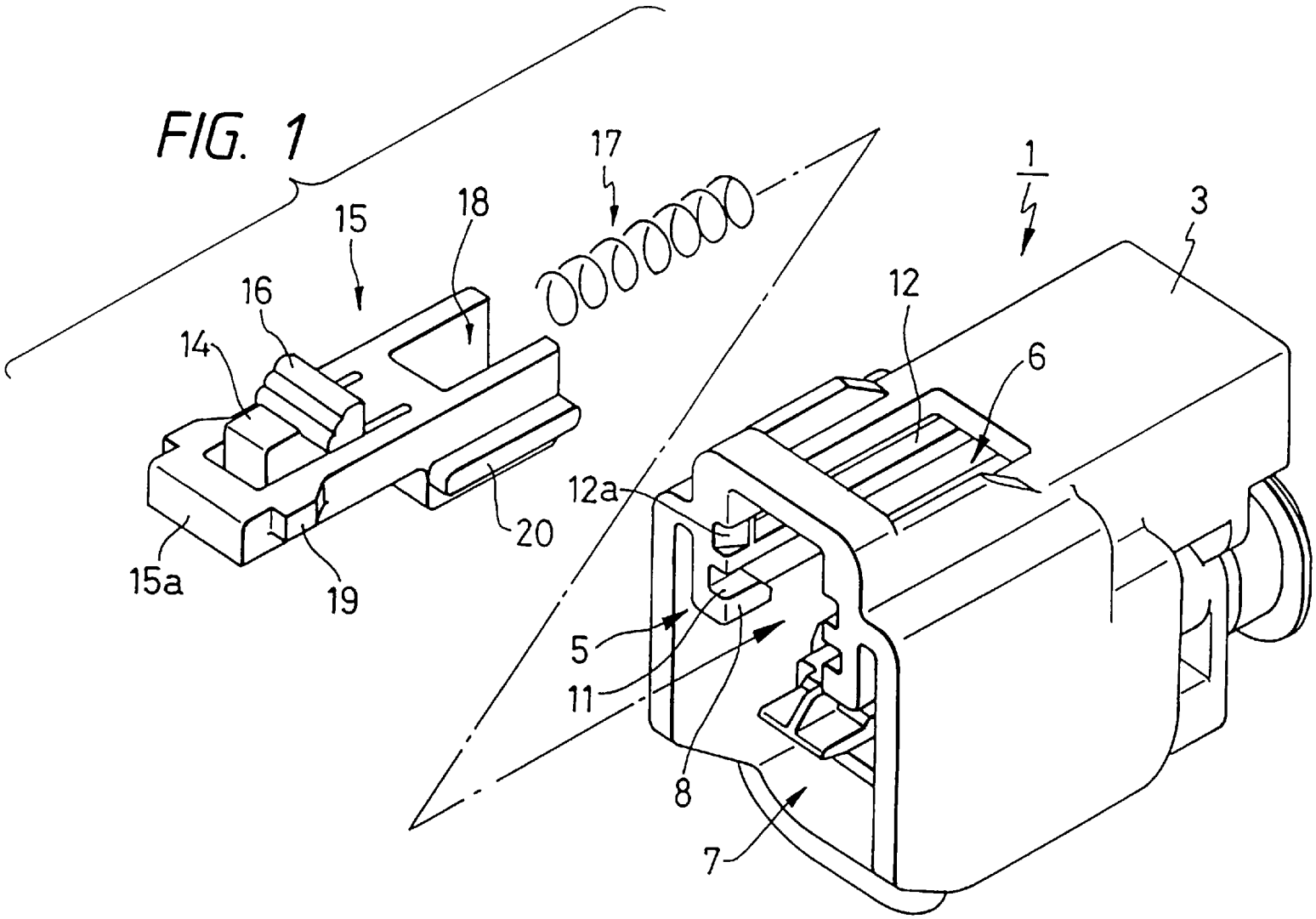
FIG. 1 is an exploded perspective view showing an exemplary female connector and an exemplary slide lock member of the connector disengaging mechanism of the invention.

A female connector 1 shown in FIG. 1 has a terminal accommodating chamber 7 in a lower portion of a housing 3 and an accommodating space 5 in an upper portion of the housing 3. The terminal accommodating chamber 7 allows a connecting terminal to be inserted and retained therein. The accommodating space 5 allows a slide lock member 15, which will be described later, to be inserted and retained therein. A pair of lower guide grooves 11 and a pair of upper guide grooves 12 are provided respectively on both sides of the accommodating space 5 as a support mechanism. Front end portions of the pair of upper guide grooves 12 are tapered so as to form slide lock retaining portions 12*a*. The slide lock retaining portions 12*a* prevent the slide lock member 15 from coming off. The front end portions of the pair of lower guide grooves 11 have incomplete engagement preventing lock stoppers 8. An opening 6 is formed in the housing 3 so as to open the upper portion of the accommodating space 5.

The slide lock member 15 includes a disengaging arm 14 and slide stoppers 19. The disengaging arm 14 has a flexible separating projection 16 on the upper surface thereof, the flexible separating projection 16 is pressed in the disengaging operation. The slide stoppers 19 are arranged on both side surfaces of the slide lock member 15 close to the separating projection 16 and are fitted into the pair of upper guide grooves 12 within the housing 3. Further, a spring accommodating chamber 18 is formed at a rear portion of the slide lock member 15. Support projections 20 are formed on both side surfaces of the slide lock member 15 close to the spring accommodating chamber 18. The spring accommodating chamber 18 accommodates a compression spring 17 that is a resilient member. The support projections 20 are fitted into the pair of lower guide grooves 11.

Figure 2:
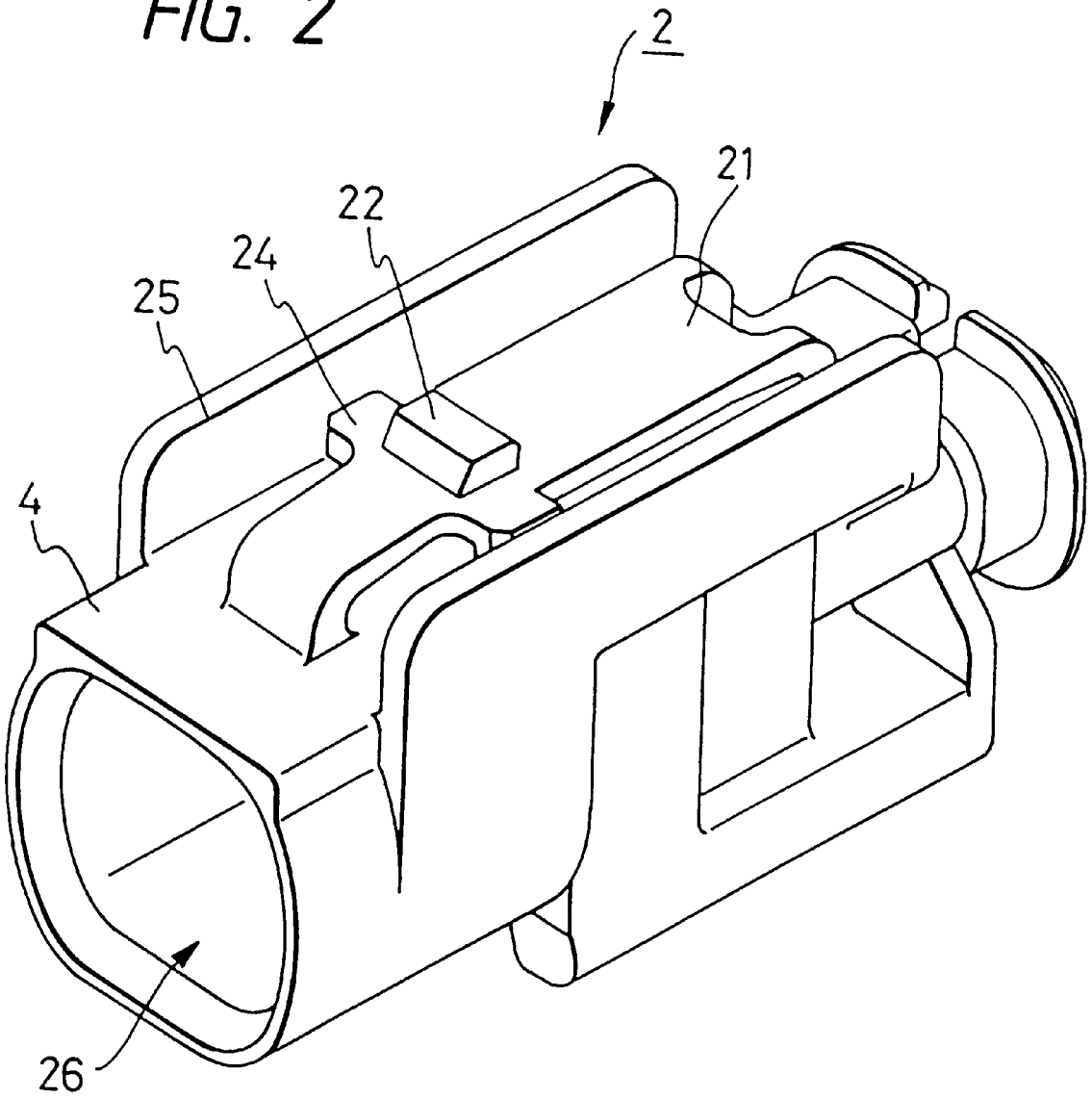
FIG. 2 is a perspective view showing an exemplary male connector of the connector disengaging mechanism of the invention.

Further, a male connector 2 shown in FIG. 2 has a terminal accommodating chamber 26 in a male housing 4 thereof. The terminal accommodating chamber 26 allows a connecting terminal to be inserted and retained therein. A flexible lock arm 21 is formed on top of the housing 4, and guide walls 25 are erected on both side walls of the housing 4.

Further, a housing lock 22 is formed at a predetermined position on top of the lock arm 21. The housing lock 22 is retained by the slide lock member 15. A pair of incomplete engagement preventing locks 24 are formed on a side portion of the lock arm 21 close to the housing lock 22.

In the thus constructed connector disengaging mechanism of the invention, first, the support projections 20 are inserted respectively into the lower guide grooves 11 with the compression spring 17 having been accommodated in the spring accommodating chamber 18 of the slide lock member 15, and then, the slide lock member 15 is assembled to the housing 3 by inserting the slide stoppers 19 into the pair of upper guide grooves 12.

Then, the female connector 1 is engaged with the male connector 2. That is, when the male connector 2 is pushed into the female connector 1, the front end of the housing lock 22 of the lock arm 21 comes in contact with a pushing end face 15*a* on the front end of the slide lock member 15 so that the slide lock member 15 is moved, and further the incomplete engagement preventing locks 24 are positioned on the incomplete engagement preventing lock stoppers 8.

Under this condition, even if the lock arm 21 tends to flex downward, since the incomplete engagement preventing locks 24 are in contact with the upper surfaces of the incomplete engagement preventing lock stoppers 8, the lock arm 21 is in no way allowed to flex.

Figure 3:
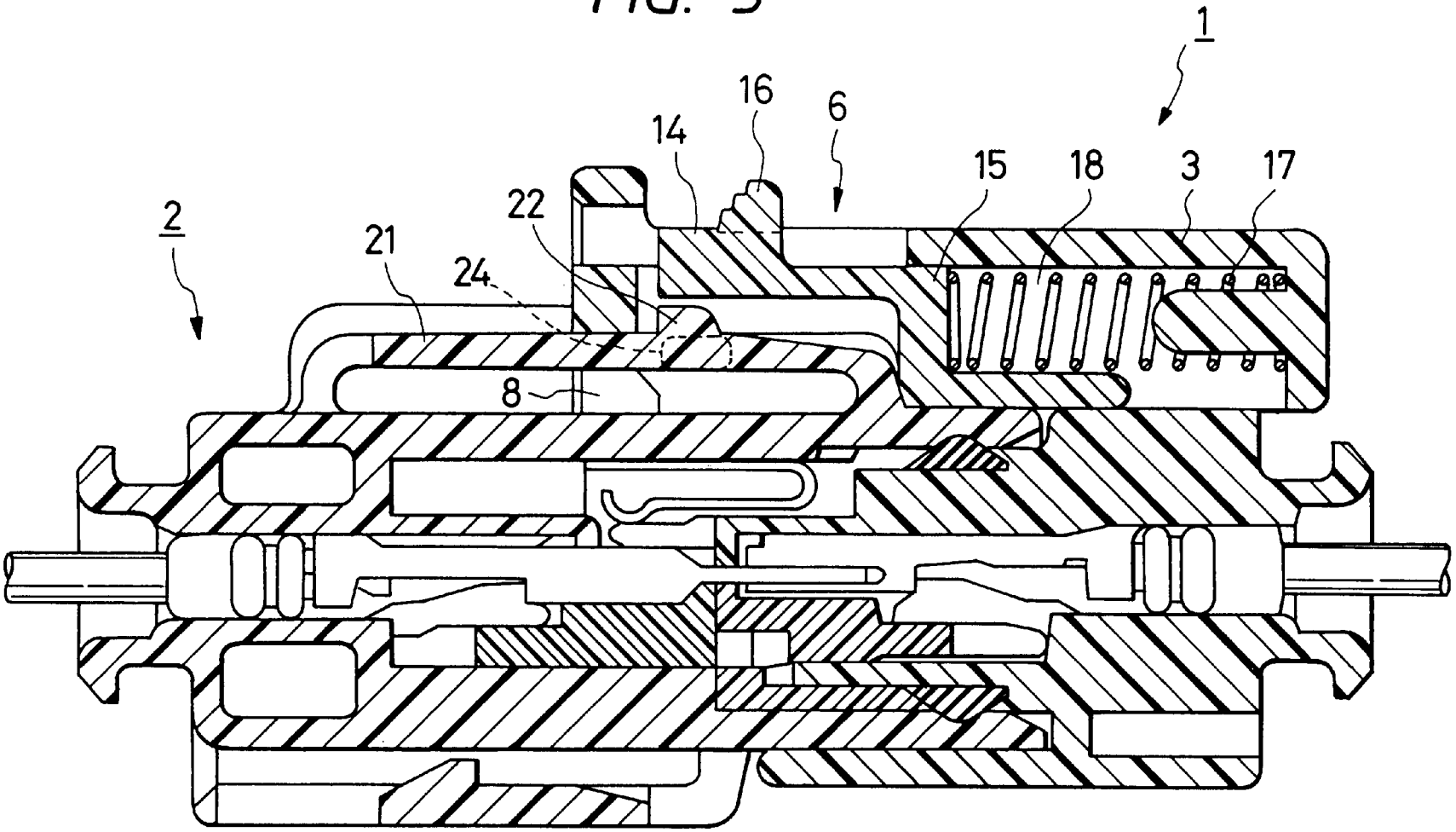
FIG. 3 is an operation explaining diagram showing a condition in which the connectors are completely engaged.

As shown in FIG. 3, when the male connector 2 is further pushed while the connector 2 resists the pressure of the compression spring 17, the incomplete engagement preventing locks 24 are fitted into the pair of lower guide grooves 11 while riding over the incomplete engagement preventing lock stoppers 8, and further, the pushing end face 15*a* of the slide lock member 15 rides over the tapered surface of the housing lock 22 while causing the lock arm 21 to flex downwardly by the pressure of the compression spring 17.

Therefore, the backward movement of the slide lock member 15 in the engaging direction causes the housing lock 22 to be retained in the lower portion of the slide lock member 15, thereby completing the engagement of the female connector 1 with the male connector 2.

Figure 4:
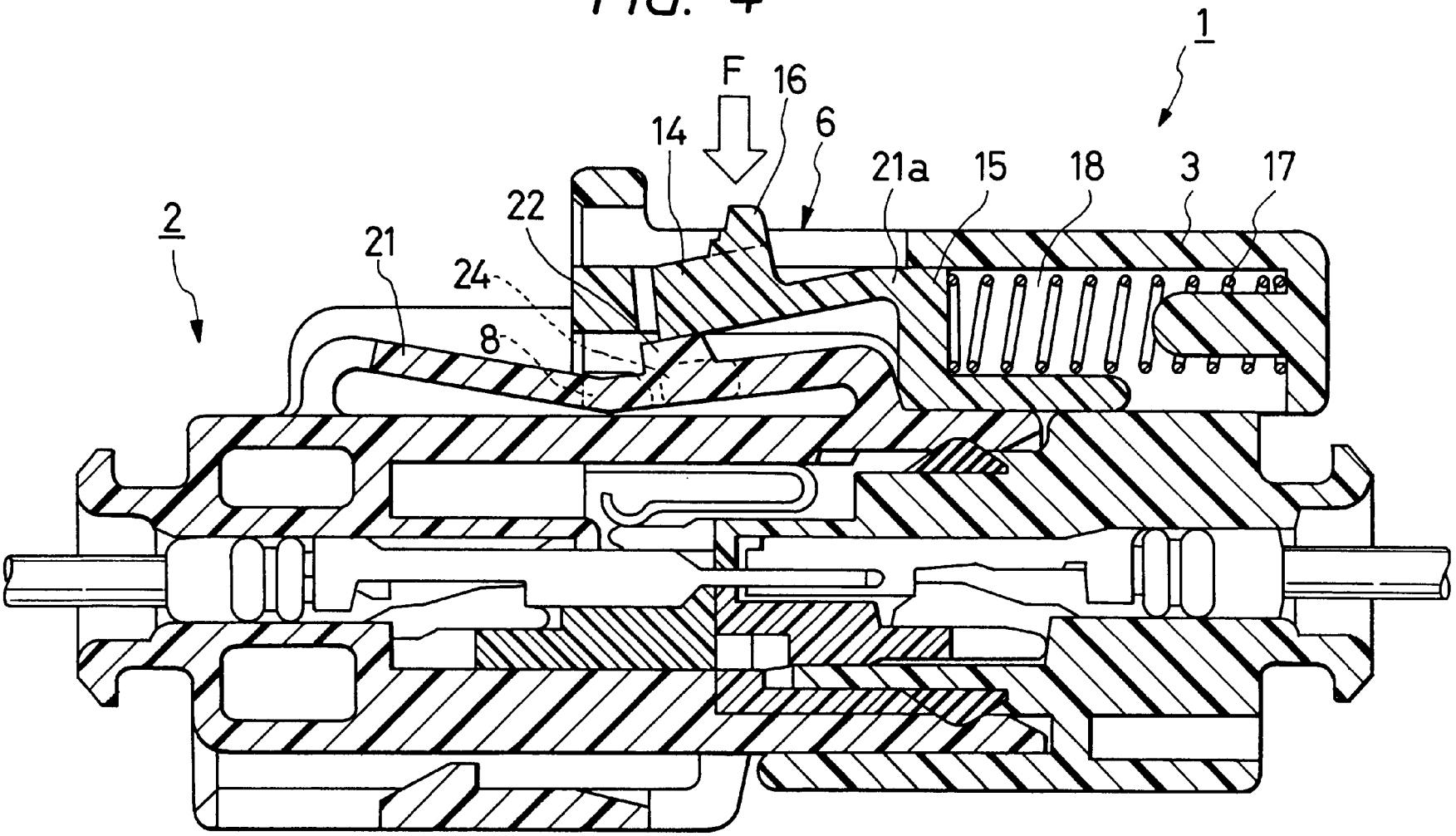
FIG. 4 is an operation explaining diagram showing a condition in which the engaged connectors in FIG. 3 are in the course of getting disengaged.

Then, as shown in FIG. 4, in order to disengage the female connector 1 from the male connector 2, a biasing force F is applied to the separating projection 16 of the slide lock member 15 from above with a finger of a hand or the like, so that the disengaging arm 14 turns downwardly with a pivot portion 21*a* as a pivot. As a result of this turning, the lower surface of the disengaging arm 14 comes in contact with the housing lock 22 that is retained in the lower portion of the disengaging arm 14. When the biasing force F is continuously applied, the lock arm 21 in the housing lock 22 portion flexes downwardly, so that the retained condition of the housing lock 22 is released.

Figure 5:
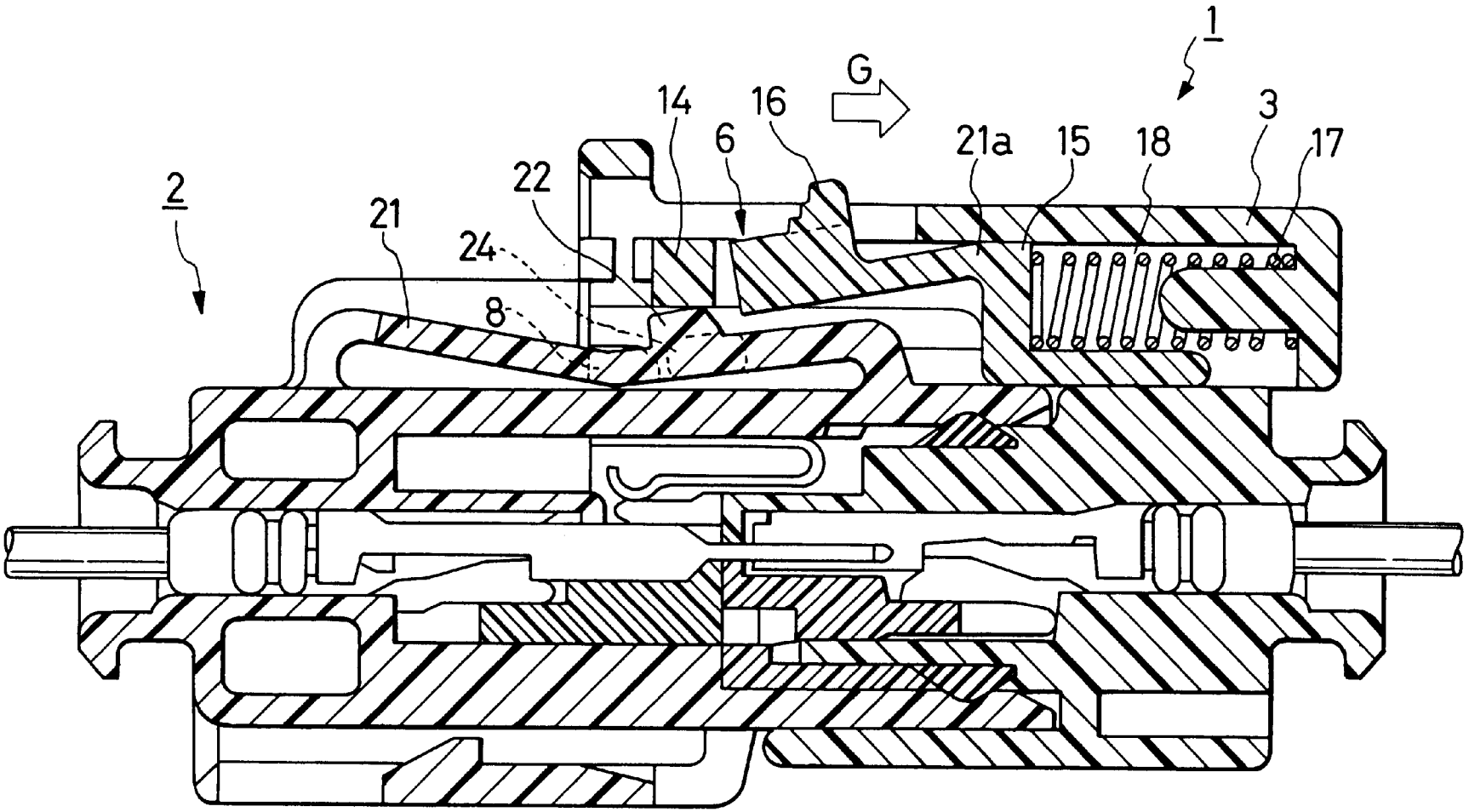
FIG. 5 is an operation explaining diagram showing a condition in which the connectors in FIG. 4 are completely disengaged.
Figure 6:
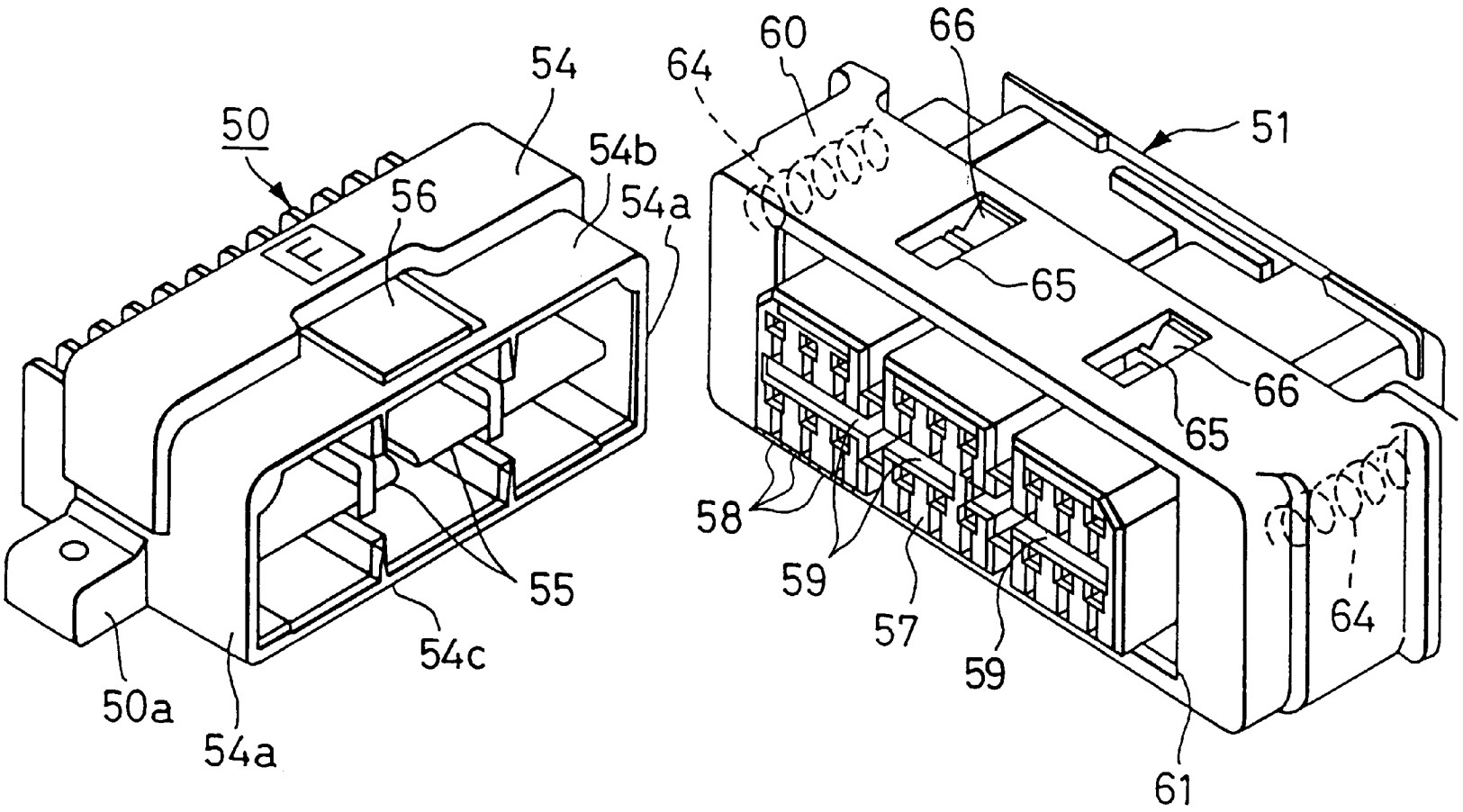
FIG. 6 PRIOR ART
FIG. 6 is a perspective view showing an exemplary construction of conventional connectors.
Figure 7:
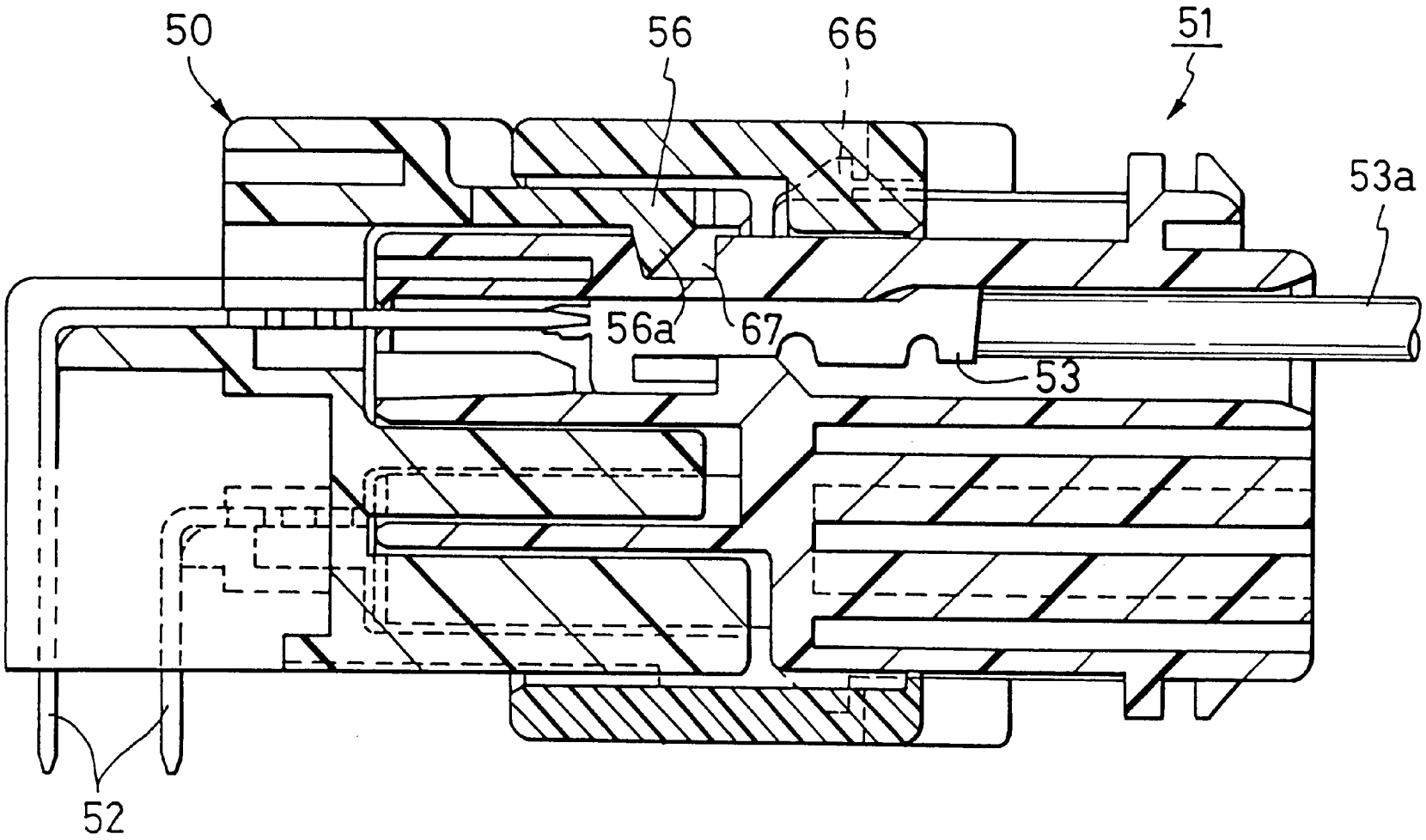
FIG. 7 PRIOR ART
FIG. 7 is a longitudinal sectional view showing a completely engaged condition of the connectors in FIG. 6.

Then, when the housing 3 is pulled in the direction indicated by the arrow G as shown in FIG. 5, the male connector 2 can be separated from the female connector 1 easily.

As described above, according to the thus constructed connector disengaging mechanism of the invention, the disengaging arm 14 flexes downwardly with the separating projection 16 of the slide lock member 15 pressed from above at the time of disengaging the connectors from each other. Further, when the housing lock 22 of the lock arm 21 positioned below the disengaging arm 14 is pressed downwardly as a result of the flexion of the disengaging arm 14, the lock arm 21 in the housing lock 22 portion flexes downwardly, which in turn releases the retained condition of the housing lock 22 in the disengaging arm 14.

When the separating projection 16 is pushed in the disengaging direction under this condition, the connectors can be disengaged even by a single hand easily.

As described in the foregoing, according to the connector disengaging mechanism, in order to disengage the connectors from each other, the disengaging arm flexes downwardly by pressing the separating projection of the slide lock member from above, and such flexion of the disengaging arm causes the lock arm positioned below the disengaging arm to flex downwardly, which in turn releases the retained condition of the housing lock.

Therefore, either by pushing or pulling the slide lock member in the disengaging direction, the connectors can be disengaged even by a single hand easily.

In addition, the operator can perform the connector disengaging operation with a single hand while holding the side walls of the housing since the slide lock member is covered with the housing.

What is claimed is:

1. A connector disengaging mechanism for disengaging a pair of mutually engaged connectors from each other by pressing a predetermined position on at least one of the connectors, said connector disengaging mechanism comprising:

a first connector including:

a first housing;

a first terminal accommodating chamber, for accommodating a first terminal, formed in the first housing;

a slide lock member slidably accommodated within the first housing;

a resilient member positioned between the slide lock member and an inner wall of the first housing; and a support mechanism formed in the first housing to support the slide lock member; and a second connector including:

a second housing having a lock member for engaging the slide lock member when the first and second connectors are connected to each other; and a second terminal accommodating chamber, for accommodating a second terminal, formed in the second housing, wherein the first and second connectors are disengaged from each other by pressing a predetermined position of the slide lock member; and wherein the lock member of the second housing includes a flexible lock arm, a housing lock retained by the slide lock member above an upper portion of the flexible lock arm, and incomplete engagement preventing locks projecting respectively from side surfaces of the lock arm.

2. A connector disengaging mechanism for disengaging a pair of mutually engaged connectors from each other by pressing a predetermined position on at least one of the connectors, said connector disengaging mechanism comprising:

a first connector including:

a first housing;

a first terminal accommodating chamber, for accommodating a first terminal, formed in the first housing;

a slide lock member slidably accommodated within the first housing;

a resilient member positioned between the slide lock member and an inner wall of the first housing; and a support mechanism formed in the first housing to support the slide lock member; and a second connector including:

a second housing having a lock member for engaging the slide lock member when the first and second connectors are connected to each other; and a second terminal accommodating chamber, for accommodating a second terminal, formed in the second housing, wherein the first and second connectors are disengaged from each other by pressing a predetermined position of the slide lock member; and wherein the support mechanism includes first guide grooves and second guide grooves; and wherein the slide lock member has slide stoppers inserted into the first guide grooves and support projections inserted into the second guide grooves.

3. The connector disengaging mechanism of claim 1, wherein the support mechanism has a lock stopper for preventing an incomplete engagement of the connectors, the lock stopper suppresses flexion of the lock arm caused during connector engaging operation in cooperation with an operation of the incomplete engagement preventing locks.

* * * * *